US005645194A

United States Patent [19]

Tyner

[11] Patent Number: 5,645,194

[45] Date of Patent: Jul. 8, 1997

[54] SYSTEM FOR FILLING MEDICAL NUTRITION CONTAINERS

[75] Inventor: Clifford A. Tyner, Grass Valley, Calif.

[73] Assignee: U.S. Medical, Inc., Hingham, Mass.

[21] Appl. No.: 607,700

[22] Filed: Feb. 27, 1996

Related U.S. Application Data

[62] Division of Ser. No. 388,183, Feb. 13, 1995, Pat. No. 5,494,196, which is a continuation of Ser. No. 851,960, Mar. 16, 1992, abandoned.

[51] Int. Cl.[6] ..... B65B 1/04

[52] U.S. Cl. ..... 222/147; 141/114; 141/392; 141/10; 215/30; 604/111

[58] Field of Search ..... 222/147, 522, 222/523, 525, 153.01, 153.14, 541.6, 541.1; 215/14, 47, 256, 30, 48, 49; 220/86.4; 383/5; 137/797; 604/110, 111; 53/469; 141/10, 18, 98, 114, 313, 392, 346, 383

[56] References Cited

U.S. PATENT DOCUMENTS

| | | | |
|---|---|---|---|
| 4,396,383 | 8/1983 | Hart | 604/56 |
| 4,458,733 | 7/1984 | Lyons | 141/114 |
| 4,507,114 | 3/1985 | Bohman et al. | 604/111 |

*Primary Examiner*—Henry J. Recla
*Assistant Examiner*—Steven O. Douglas
*Attorney, Agent, or Firm*—Samuels, Gauthier, Stevens & Reppert

[57] ABSTRACT

A method for filling and using an infusion bag useful in medicinal and related applications. The infusion bag comprises a bladder having at least two ports, an inlet port and an outlet port. The inlet port includes a valve which can be moved to an open position for filling of the bladder and then moved to a closed position to seal the bladder. The outlet port communicates with a catheter or the like.

1 Claim, 2 Drawing Sheets

SYSTEM FOR FILLING MEDICAL NUTRITION CONTAINERS

This application is a divisional application of U.S. patent application Ser. No. 388,183 filed Feb. 13, 1995, now U.S. Pat. No. 5,494,196, which patent is a continuation of U.S. patent application Ser. No. 851,960, filed Mar. 16, 1992, now abandoned.

BACKGROUND OF THE INVENTION

1. Field of the Invention

The present invention relates to the field of medical infusion apparatus. More specifically, the present invention relates to tamper resistant medical filling and containment systems which provide for ease in filling and use.

2. Description of the Prior Art

In medical and related applications, it is often desirable to introduce a selected amount of a fluid solution, e.g., a nutrition solution, into the body of a patient over a predetermined period of time. Systems which have been developed to address this need generally include an infusion bag having two openings, where at least one opening is connected to a tube which in turn is connected to a catheter. In practice, the plastic infusion bag is filled with a nutrition solution through a fill tube connected to one of the openings. When the bag has been filled, the fill tube is clamped shut with either a plastic clamp or a metal crimp and the free end of the fill tube is cut off and discarded.

Disadvantages which have heretofore existed with these systems include their difficulty of use, lack of aesthetic appeal and susceptibility to tampering.

The current methods suffer from clamps that are lost before they can be used, bulky and unsightly protrusions on the outside of the bag, crimps that require additional tools to use and a product that is not altogether tamper-proof.

SUMMARY OF THE INVENTION

The present invention addresses the above noted and other disadvantages of prior art filling and containment systems. The present invention comprises a filling system including an integral fill tube whereby the fill tube may be essentially removed from the system and bag when the filling operation is completed without the use of tools or separate crimps or clamps. Moreover, the infusion bag, once filled, is resistant to tampering.

In a preferred embodiment, the system includes a collapsible infusion bag provided with two or more openings formed at one end or edge of the bag in a conventional fashion. These openings include at least one fill port through which the bag may be filled, and at least one outlet port which may be connected to a flow conduit which in turn may be connected to a catheter. The fill port used to introduce a given fluid solution into the bag is receivable to a valve comprising a cylindrical body or valve stem which may be reciprocated between an "open" and a "closed" position. This valve is preferably hollow along at least a portion of its length to allow for fluid flow therethrough. When positioned in an "open" position, the valve allows a given fluid to be introduced into the bag. When moved to a "closed" position within the fill port, external ridges on the outer diameter of the valve press against the inner wall of the port, effectively seating the valve stem. When maintained in a "closed" position over a period of time, the elastic memory of the plastic forming the opening preferably secures the valve stem in this "closed" position.

In another preferred embodiment, a reciprocating valve stem comprises a cylindrical body with a smaller diameter portion situated along its length. This smaller diameter portion allows the exposed filling end of the valve to be removed once the valve is moved to a "closed" position. In such a fashion, the valve cannot easily be reciprocated to an "open" position as to allow access to the fluid contents of the bag.

The filling system of the present invention has a number of advantages over the prior art. One such advantage is the increased ease in the filling operation provided by the reciprocating valve comprising the valve stem and the fill port.

Another advantage of the present invention is that it removes the need to use a separate tube clamp or other similar mechanism to prevent fluid flow through the neck of the filling port after the bag is filled. Still another advantage is the fact that the system can be closed without the need for additional tools. Moreover, the filled container is more aesthetically pleasing due to the elimination of the tube clamp and is tamper resistant.

Other advantages of the invention will become apparent to those skilled in the art in view of the following detailed description and accompanying drawings.

DESCRIPTION OF THE PREFERRED EMBODIMENT

Figure 2:
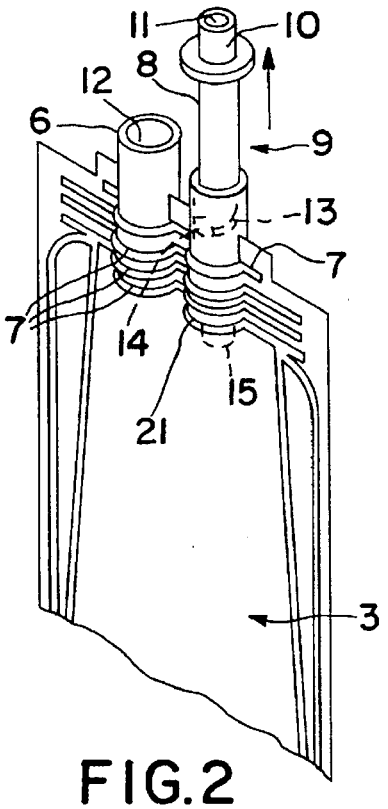
FIG. 2 illustrates the embodiment disclosed in FIG. 1 where the valve is disposed in a "closed" position.
Figure 1:
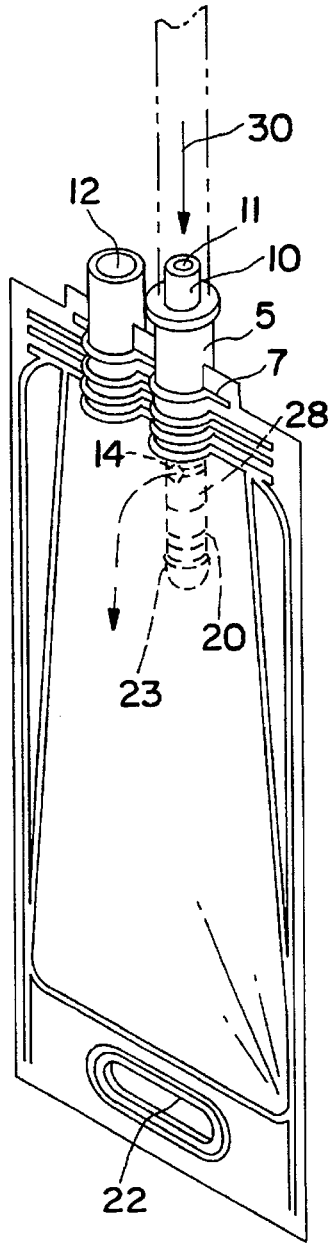
FIG. 1 illustrates a perspective view of one embodiment of the infusion system of the present invention wherein the valve is shown situated in an "open" position.
Figure 3:
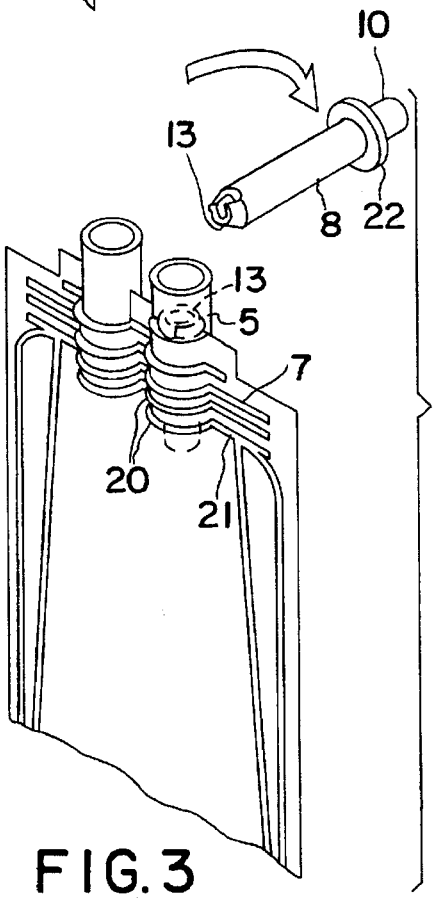
FIG. 3 illustrates the view of one embodiment disclosed in FIG. 2 wherein the filling end of the reciprocating valve has been removed.

In accordance with a preferred embodiment of the present invention by reference to FIGS. 1–3, there is provided an infusion bag 3 and a valve 9. Infusion bag 3 described herein is preferably made from two superimposed sheets of plastic material welded around their edges to form a gas-tight bladder. In a preferred embodiment, a malleable gas impermeable plastic, such as Non-Dop PVC as manufactured by Ella Plastics, is used, although other types of materials having similar properties are also contemplated within the spirit of the invention. As illustrated in FIGS. 1–3, infusion bag 3 is preferably rectangular in shape although other configurations may also be used. It is desirable, however, that bag 3 be provided with a handle 22 or other means to carry and suspend the bag 3 as will be further described.

Fluid communication with the bladder formed within bag 3 is provided by two or more necks or openings including an inlet port 5 and an outlet port 6. As noted, the inlet ports preferably describes a tubular bore to accommodate valve stem 8. As illustrated in FIGS. 1–3, ports 5 and 6 are preferably provided with reinforcing ribs 7 or the like to enhance their axial rigidity. Outlet port 6 is sealed via a punctureable membrane (not shown) by methods well known in the art. When administration of the liquid within the bladder to a patient is desired, this membrane is punctured by a flow spike or the like which is coupled to a transport conduit such as a tube (not shown), which in turn is coupled to a catheter (also not shown) for delivery of the liquid within the bag to the patient. Port 5 is comprised of an exterior end 25, an interior end 24 and an inner wall 26 as shown best in FIGS. 4 and 5.

Figure 4:
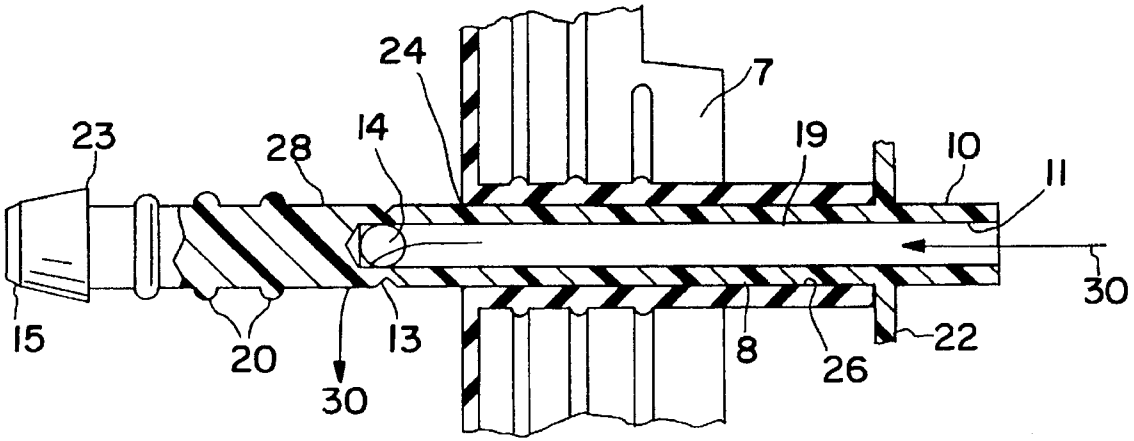
FIG. 4 is a view in partial cross section of the valve as depicted in FIG. 1.
Figure 5:
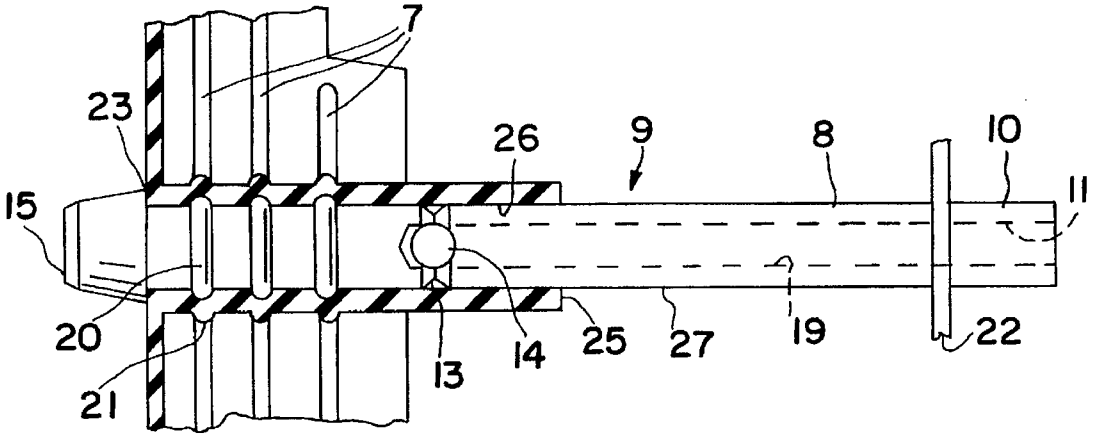
FIG. 5 is a view in partial cross section of the valve as depicted in FIG. 2.

Referring again to FIGS. 1–3 and especially to FIGS. 4 and 5, reciprocating valve 9 comprises the inlet or fill port 5, which in this embodiment acts as the valve body, and an elongate cylindrical body or valve stem 8. The valve stem 8 includes a bladder end 15 and a filling end 10. Valve stem 8 is adapted to reciprocate within the tubular bore 12 defined in inlet port 5 in a fluid-tight relationship. The movement of valve stem 8 in this fashion is illustrated in FIGS. 1–2. The filling end 10 of valve stem 8 is adapted to be coupled to a standard conduit means such as nylon or PVC tubing (not shown) to allow the bag to be filled. Preferably, this coupling is accomplished by tapering filling end 10 to allow for a friction fit with standard medical grade tubing. This filling operation is ordinarily accomplished at the pharmaceutical supply house or, in some instances, at the hospital. Filling end 10 includes a shoulder 22 to assist the user in moving the valve stem 8 between a first for "open" and a second of "closed" position as will be described below.

Valve stem 8 is comprised of a longitudinal bore 19 extending from the filling end 10 to point situated between the filling end 10 and the dispensing end 15. An aperture 11 is formed at the filling end 10. Fluid flow through valve 9 into the bag 3 is enabled by one or more passages 14 formed approximately mid way between the bladder end 15 and the filling end 10 of the valve stem 8. These passages 14 are in fluid communication with bore 19. In a preferred embodiment, passages 14 are formed at the bottom of and transverse to bore 19. Other relative orientations may also be used to accomplish the objectives of the invention.

Passages 14 are located at a point along valve stem 8 to provide fluid communication between the aperture 11 and the bladder in the bag 3 when the valve 9 is in the "open" position. Conversely, there is no fluid communication when the valve 9 is in the closed position. As shown in FIG. 1, the valve is "open" when the valve stem 8 is pushed into the bag 3 such that the shoulder 22 abuts the end of the inlet port 5. In this position, fluid (depicted by arrows 30 in FIG. 4) enters the valve stem 8 at aperture 11, flows through the bore 19 to passages 14 on into the bladder defined within bag 3. The valve 9 is "closed" by grasping the shoulder 22 and pulling the valve stem 8 until the stop 23 abuts the interior end 24 of the inlet port 5. As can be seen from FIG. 5 and FIG. 2, in the "closed" position, passages 14 are effectively blocked by the interior wall 26 of the port 5, thus, preventing fluid from flowing into or out of the bag 3.

In the preferred embodiment, valve stem 8 includes a smaller diameter portion 13, which effectively divides valve stem 8 into a filling portion 27 and bladder portion 28. The smaller diameter portion 13 is designed to allow the filling portion 27 to be cleanly and easily separated from the bladder portion 28 after the bag 3 has been filled, and yet strong enough to allow valve stem 8 to be reciprocated in port 5. While it is well known in the art how to achieve this dual purpose, it has been found that a wedge shaped cross sectional thinning formed at the passages 14 as best shown in FIG. 4, is most effective. The objective of the smaller diameter portion 13, namely being able to prevent the valve 9 from being easily or accidentally opened after filling, may be achieved by other methods without departing from the spirit of the invention.

The bladder portion 28 of valve stem 8 of valve 9 is preferably provided with a series of circumferential ridges 20. When the valve 9 is in the "closed" position, these ridges 20 form a series of complementary grooves 21 in the otherwise smooth interior wall 26 of port 5 due to the malleable nature of the plastic material used to form port 5. As can be seen in FIG. 5, it has been found advantageous to position the ribs 7 such that when the valve 9 is "closed" the ribs 7 are in alignment with the ridges 20. When valve 9 is positioned in the "closed" position for an extended period of time, e.g., two days, the memory of the plastic material forming port 5 permanently deforms to form grooves 21, thus enhancing the difficulty by which the valve may be opened.

As would be apparent to those skilled in the art, the valve of the present invention need not be integrally formed with the bag 3. If the application warranted, the port 5 could be replaced with a separate valve body.

An infusion bag may be filled in accordance with the invention by the following preferred method.

With the valve 9 in the open position, connecting a filling tube to a filling end 10 of a valve stem 8 of the valve;

filling the bag 3 with a desired fluid; and, closing the valve by pulling the valve stem 8 to a position such that there is no fluid communication between the filling end 10 of the valve stem 8 and the interior of the bag 3.

If the bag is of the type that is resealable, after the fluid has been emptied from the bag, it may be refilled by opening the valve 9 by pushing valve stem 8 to a position such that fluid communication between the filling end 10 and the interior of the bag is established and performing the foregoing steps.

If the bag is used in an application where reuse is not desirable, after filling the bag, the step of breaking off the filling portion of the cylindrical body should be performed.

While certain specific and preferred embodiments of the present invention have been illustrated herein, as will be understood by those skilled in the art, still further variations and modifications can be made therein without departing from the spirit and scope of the invention as claimed below.

I claim:

1. A method for filling an infusion bag having a bladder, at least two ports and a valve, where said valve comprises a valve stem reciprocably disposed in at least one of said ports where said valve stem defines a bladder end and a filling end where said valve stem is also provided with an axial bore formed partially therethrough with an aperture provided at its filling end; said valve stem being moveable between an "open" and a "closed" position where said "open" position allows for fluid flow through said valve stem into said bladder, and said closed position prevents fluid flow through said valve stem, the method comprising the steps of:

filling the bag with a desired fluid through said valve stem;

closing the valve by pulling the valve stem to a "closed" position to prevent fluid flow therethrough;

removing the filling end of said valve stem to prevent said valve stem from being moved to an open position.

* * * * *